US006414053B2

(12) United States Patent
Fernandez et al.

(10) Patent No.: US 6,414,053 B2
(45) **Date of Patent: *Jul. 2, 2002**

(54) PROCEDURE FOR THE PRODUCTION OF FERRULES AND OTHER FEEDING HEAD AND SUPPLY ELEMENTS FOR CASTING MOLDS, AND FORMULATION FOR THE OBTENTION OF SAID FERRULES AND ELEMENTS

(75) Inventors: Tomas Posada Fernandez; Rafael Sampedro Gerenabarrena; Francisco Jose Diaz Maruri; Jaime Prat Urrestieta; Jose Joaquin Lasa Urteaga; Luis Iglesias Hernandez, all of Idiazabal (ES)

(73) Assignee: Kemen Recupac S.A., Idiazabal (Guipuzcoa) (ES)

( * ) Notice: Subject to any disclaimer, the term of this patent is extended or adjusted under 35 U.S.C. 154(b) by 0 days.

This patent is subject to a terminal disclaimer.

(21) Appl. No.: 09/726,691

(22) Filed: Nov. 30, 2000

Related U.S. Application Data

(63) Continuation of application No. 09/043,350, filed on Sep. 17, 1998.

(30) Foreign Application Priority Data

Jul. 18, 1996 (ES) ..... 9601607
Jul. 8, 1997 (ES) ..... 9701518

(51) Int. Cl.[7] ..... C08K 3/00

(52) U.S. Cl. ..... 523/218; 523/219

(58) Field of Search ..... 523/218, 219

(56) References Cited

U.S. PATENT DOCUMENTS 6,197,850 B1 * 3/2001 Fernandez et al. ..... 523/28 F

* cited by examiner

*Primary Examiner*—Edward J. Cain
(74) *Attorney, Agent, or Firm*—Notaro & Michalos P.C.

(57) ABSTRACT

The ferrules and feeding head and supply elements, insulating or exothermic, are obtained by blowing or manual molding from a formulation which comprises aluminium silicate hollow micro beads, with an alumina content below 38% in weight, an agglomerant and optional loads, in non fibrous form. Depending on the density of the micro beads, appropriate formulations may be obtained for the manufacture of ferrules and insulating and exothermic feeding head and supply elements. the ferrules obtained, have an external and internal dimensional exactness and may be coupled to the mold after production, without additional handklings and in a manual or automatic manner. Said ferrules are of interest in the production of metallic ferreous or non ferreous parts.

9 Claims, 2 Drawing Sheets

PROCEDURE FOR THE PRODUCTION OF FERRULES AND OTHER FEEDING HEAD AND SUPPLY ELEMENTS FOR CASTING MOLDS, AND FORMULATION FOR THE OBTENTION OF SAID FERRULES AND ELEMENTS

CROSS REFERENCE TO RELATED APPLICATIONS

This application is a continuation application of U.S. application Ser. No. 09/043,350, filed Sep. 17, 1998, now U.S. Pat. No. 6,197,850.

FIELD OF THE INVENTION

This invention refers to ferrules and other feeding head and supply elements for casting molds, suitable for manufacturing metallic parts, to a procedure for their obtention, and also to suitable formulations for the production of the same.

BACKGROUND OF THE INVENTION

As is known, the obtention of metallic parts by means of molding, comprises the pouring of cast metal into a mold, the solidification of the metal through cooling and the demolding or extraction of the formed part, by means of the removal or destruction of the mold.

Said molds may be metallic or may be formed by aggregates of different materials (ceramics, graphites and especially, sand), normally hardened by the action of agglomerates. Generally, the sand molds are obtained by filling a molding die with sand.

Said molds shall be equipped with gates or orifices for the communication between the internal and the external cavity, through which the cast metal in molding or casting form, is poured. Likewise, due to the shrinkage of the metal during the cooling, the mold shall be provided with vertical cavities or flash channels which are filled with reserve cast metal with the object of forming a feeding head intented to compensate the shrinkage or drawing of the metal.

The purpose of the feeding head is to supply the part when the medium is shrunk in the same, due to which the metal shall be kept in the feeding head in liquid condition a longer time than the part. For this reason, the flash channels are normally covered with ferrules manufactured with isothermic or even exothermic refractory materials (insulations) which delay the cooling of the metal contained in the feeding heads in order to ensure its fluidity when the drawing in the cast metal is produced.

The gates through which the cast metal is poured are also constructed from refractory, insulating and even exothermic materials, with similar composition to that of the ferrules.

Suitable insulation refractory compositions are known for the production of ferrules and other feeding head and supply elements for casting molds, with insulating properties, constructed from a refractory material in the manner of particles, organica and/or inorganic fibers and agglomerantes.

Sutiable exothermic refractory compositions are also known for the production of ferrules and other heeding head and supply elements for casting molds, with exothermic properties, comprised of a refractory filler material in the form of fibers or particles, agglomerants and, optionally, selected loads from among an easily oxidizable metal and an oxidant agent, capable of oxidizing said metal. Additionally, in order to improve the sensitivity of the exothermic refractory composotion, an inorganic fluorine flux is generally included. British Patentes Nos. GB 627678, 774491, 889484 and 939541 disclose exothermic refractory compositions which contain inorganic fluorides.

Additionally, the PCT application, published with International Publication Number W094/23865, discloses a composition for a casting mold of metals which comprises hollow micro beads containing alumina, in which the alumina content is at least, 40% in weight.

The great majority of the ferrules which are consumed at world level are manufactured by vacuum and wet molding, followed by drying and polymerization of the resins at high temperature, such as is mentioned in Spanish Patent N° ES-8403346. A standard procedure of this type comprises the stages of:

- the suspension in water of a mixture formed by the materials used in the manufacturing of the ferrule, for example, aluminosilicate fibers, aluminium, iron oxide and phenolic resins, or alternatively, a mixture formed by siliceous sands, aluminium scoria, cellulose, aluminium and phenolic resins;
- the aspiration of said aqueous suspension by means of vacuum through an exterior and interior mold; and
- the demolding of a green or wet ferrule, deposited on a tray, which in turn is introduced into an oven in which it remains between 2 and 4 hours at a temperature of approximately 200° C., and finally, left to cool.

On occasions, all the aluminosilicate stock material is not found in the form of fibers since a part of the same may have been replaced by hollow micro beads of said aluminosilicate material with the object of decreasing the necessary quantity of product and reducing the cost of the final product. Such micro beads are then used as loading element.

This procedure permits the obtention of insulating or exothermic ferrules, but it presents numerous disdadvantages, among which the following are to be found:

- the impossibility of obtaining ferrules with the sufficient external dimensional exactitude, since the aspiration of the mixture through the mold produces a good exactness of the ferrule on the internal face (the one which is in contact with the mold) but not of the other face. This inexactitude makes the external contour of the ferrules not coincide dimensionally with the internal cavity of the flash channels, often originating important difficulties for its placement and attachment. Even when there is a double mold, it is difficult to keep to the measurements due to its subsequent handling in green condition. In this sense, techniques have been developed for the placement of the ferrules in their housing, such as is disclosed in German Patent N° DE P 29 23 393.0;
- it requires long production times;
- it presents difficulties in the homogeneization of the mixtures;
- it impossibilitates the introduction of rapid changes in the formulation;
- it presents certain hazards during the manufacturing process and polution of residual waters; and
- the materials used in the form of fibers may cause alergical pathologies, such as itching, and skin and mucous irritation, to the operators.

Another procedure for the manufacturing of ferrules consists in mixing sand, exothermic materials and a specific type of resin, for example, mixing sodium silicate and alkaline or novolac phenolic resins, and subsequently, per-forming a manual or blow molding of the obtained mixtures. With said procedure, parts of great dimensional exactitude may be obtained, both internal and external, with exothermic properties, though never with insulating properties. Though this procedure is simpler that the wet means, its employment presents serious limitations since, on one hand, it is not possible to obtain ferrules with insulating characteristics and, on the other hand, the ferrules obtained are extraodinarily hygroscopic.

Finally, Application W094/23865 discloses a blowable composition based on aluminium silicate hollow micro beads, though requiring that the alumina content of the same be over $40^a$, which makes unusable a significant part of said by product, because a very important part of the aluminium silicate hollow micro beads generated as industrial by product, have a lower richness than the 40% weight in alumina.

As may be appreciated, a procedure exists for the manufacturing of ferrules by wet means and vacuum molding which provides ferrules equipped with insulating or exothermic properties, though with dimensional inexactitude, the development of which presents numerous disadvantages, and on the other hand, there exists a simpler production procedure of ferrules by dry means and manual or blow molding, though only permitting the obtention of ferrules provided with exothermic properties, not insulation, but with dimensional exactness.

It would be very desirable to have ferrules and other feeding head and supply elements provided with insulating or exothermic properties, which would present dimensional exactness, and which, additionally, could be. manufactured by means of a simple procedure which would overcome the previously indicated disadvantages as regards the known procedures. The invention provides a solution to said problems which comprises the use of a refractory material, such as aluminium silicate, in the form of hollow micro beads with an alumina content below 38% in weight, in the formulation of a suitable composition for the production of said ferrules and feeding head and supply elements for casting molds.

Consequently, an object of this invention is constituted by the use of aluminium silicate hollow micro beads with an alumina content below 38% in weight in the formulation of a composition which is totally exent of refractory, insulating or exothermic material, in the form of fibers, suitable for the manufacturing of ferrules and other feeding head and supply elements for casting molds, insulating or exothermic.

Another object of the invention is constituted by a suitable formulation for the manufacturing of ferrules and other feeding head and supply elements for casting molds, which comprises aluminium silicate, hollow micro beads with an alumina content below 38% in weight, an agglomerant and optional loads. The ferrules and other feeding head and supply elements, manufactured parting form the previously mentioned formulation, which may be insulating or exothermic, as well as their manufacturing procedure, constitute additional objects of this invention.

On the other hand, industrial experience in nodular casting manifests that in parts with a silicon content equal to, or over 2,8%, a thickness over 20 mm and a fluorine content in green sand over 300 ppm (parts per million), a reaction takes place causing in the parts whitish pores which makes them unserviceable.

The fluorine causing the rejection of the parts may come from the bentonite, the water or the sand, but, mainly, from the fluoride derivates used in the composition for the obtention of exothermic ferrules, because of which, if said ferrules are used extensively, the circuit of green sand may be made to reach undesirable limits in fluorine contents.

Therefore, it would be very desirable that the ferrules and other suitable exothermic elements for the nodular casting should not contribute fluorine, or that the fluorine contributions should be very reduced. The invention offers a solution to said problem which comprises the employment of an insert, the composition of which contains an inorganic fluorine flux, in the manufacturing of ferrules and exothermic feeding head and supply elements suitable for nodular casting, and which is fixed on a zone of said ferrules and elements.

Consequently, an additional object of this invention is constituted by a procedure for the production of ferrules and exothermic feeding head and supply elements, suitable for nodular casting which comprises the formation and attachment of an insert made up of an inorganic fluorine flux, over a formed composition, forerunner of said ferrule or element constituted by aluminium silicate hollow micro beads with an alumina content below 38% in weight, an agglomerant and optional loads.

DETAILED DESCRIPTION OF THE INVENTION

Figure 1:
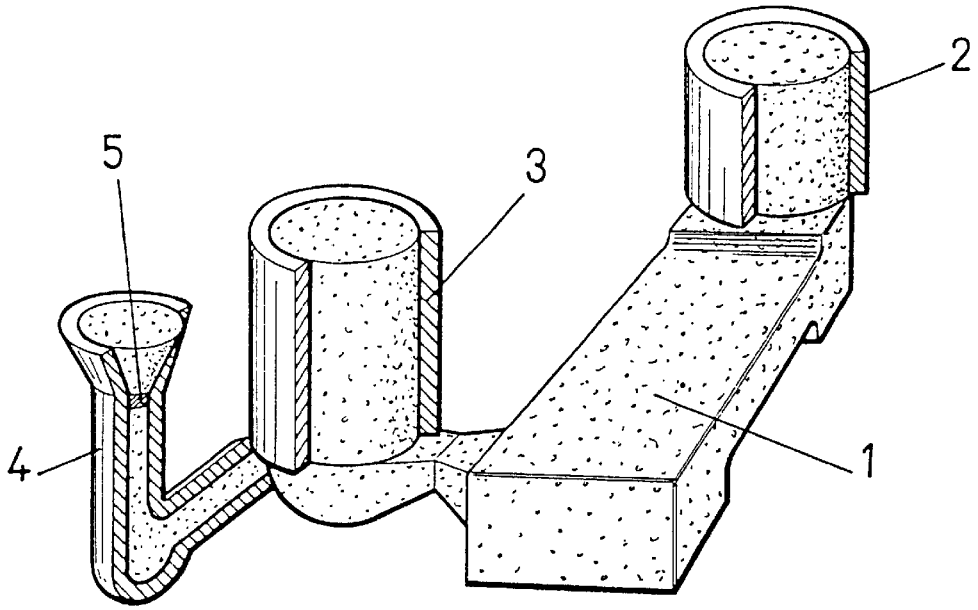
FIG. 1 represents a practical embodiment of the casting of a metallic part, as well as the main integrating elements of the process. As may be observed, this figure represents a practical and typical example of the traditional casting process of a part (1), in the casting process of which, upper (2) and lateral (3) ferrules, a gate (4) and its filter (5) have been used. The part (1), when cooled, shrinks absorbing metal from the ferrules (2) and (3), which, to permit that said material flows towards the part, must be equipped with said casting material in liqud phase, since otherwise, it would not be capable of contributing the material required by the part during its cooling.
Figure 2:
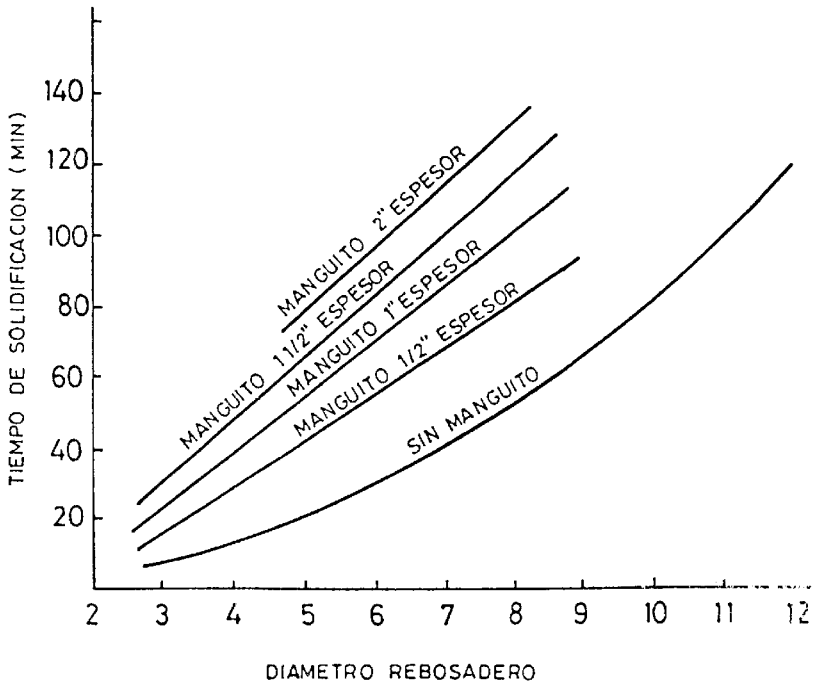
FIG. 2 is a graph which shows the metal cooling curves based on the thickness of the ferrules used, demonstrating that, in general, for a same flash channel diameter, if the ferrule thickness increases, the solidification time of the metal increases. Standing out in said figure is the lower curve (nearest the abscissa axis) which represents the cooling curve when a ferrule is not used, and how the cooling of the material is extremly rapid. The upper curves define the cooling curves obtained with the incorporation of ferrules with greater thickness, thus showing how the cooling is slower, the greater the thickness of the ferrules.

The invention provides a suitable formulation for the production of ferrules and other feeding head and supply elements for casting molds, both insulating and exothermic, which comprises aluminium silicate hollow micro beads with an alumina content below 38% in weight, preferably comprised between 20 and 38%, an agglomerant and optional loads in non fibrous form, selected from the group made up of oxidizable metals, oxidants and inorganic fluorine fluxes. Said formulation totally lacks refractory material in the form of fibers.

The aluminium silicate hollow micro beads ($AL_2O_3.S_1O_2$) which may be used in this innvention, have an alumina content below 38% in weight, preferably between 20 and 38% in weight, a grain diameter of up to 3 mm and, in general, any wall thickness. However, in a preferred embodiment of this invention, aluminium silicate hollow micro beads are used with an average diameter below 1 mm and a wall thickness of approximately 10% of the grain diameter.

Aluminium silicate hollow micro beads may be used for employment in this invention with an alumina content below 38% in weight which are commercially available.

Mainly depending on the density of the hollow micro beads, suitable formulations may be obtained for manufacturing ferrules and other feeding head and supply elements for insulation or exothermic casting molds. Thus, the lower the density of the hollow micro beads, the greater the insulation power of the obtained ferrule, whilst the denser micro beads have less insulation power. Another important factor for the selection of the hollow micro beads is their specific surface, since the smaller it is, the smaller shall be the consumption of agglomerant (resin), and consequently, the smaller shall be the global manufacturing cost of the ferrules and feeding head and supply elements, and the smaller the gaseous evolution.

Any type of resin may be used as agglomerant, both solid and liquid, which is polymerized with its appropriate catalyst after the blowing and molding of the formulation in hot die, in cold die, or else, by self-setting. For example, for the cold die curing, phenolurethane resins activated by amines (gas), epoxy-acrylic resins activated by $SO_2$ (gas), alkaline phenolic resins activated by $CO_2$or by methyl formate (gas) and sodium silicate resins activated by $CO_2$ may be used. For the hot die curing, furanic, phenolic and novolac resins may be used, activated by appropriate catalysts. In the self-setting technique (manual filling of the die of males) silicate resins may be used (for example, sodium silicate) activated by an ester, which acts as catalyst, alkydic resins activated by urethane, furanic or phenolic resins activated by an acid catalyst, phenolic-alkaline resins activated by ester, phenolic resins activated by urethane and phosphate resins activated by a metallic oxide. Though all said agglomerants are suitable for the production, according to the invention, of ferrules and feeding head and supply elements, exothermic or insulating, the practical tests conducted recommend, based on costs, resistance, mechanical characteristics and dimensional exactness, the phenol-urethane resins, activated by amine (gas) and the epoxy-acrylic resins activated by $SO_2$ (gas).

The formulation provided by this invention may contain optional loads, in non fibrous form, selected from the group formed by oxidizable metals, oxidants and inorganic fluorine fluxes.

As oxidizable metal may be used aluminium, magnesium and silicon, preferably aluminium. As oxidant may be used, alkaline or alkaline earth metal salts, for example, nitrate, chlorates and alkaline and alkaline earth metal permanganates and metallic oxides, for example, iron and manganese oxides, preferably iron oxide. As inorganiac fluorine fluxes may be used, cryolite, ($NA_3AlF_6$), aluminium and potassium tetraflucride and aluminium and potassium hexafluoride, preferably cryolite.

A typical composition provided by this invention comprises aluminium silicate hollow micro beads with an alumina content comprised between 20 and 38% in weight, aluminium, iron oxide and cryolite. In this case, when the cast metal is poured, for example, steel, on the mold, an exothermic reaction is initiated and consequence of this, the oxidation of the aluminium is initiated, causing an additional alumina which, added to the one already contained in the aluminium silicate hollow micro beads, improves the refractory characteristics of the ferrule and any other feeding head and supply element. In this way, aluminium silicate hollow micro beads with a low alumina content (below 38% in weight) may be used, versus that taught by the state of the art as recommendable (over 40% in weight, W094/23865), which had not been previously used as refractory compound in the production of ferrules and other feeding head and supply elements due to their low content in alumina. Additionally, said low alumina content micro beads are cheaper than those with a higher alumina content, due to which, its use has a double interest: to make use of a by product coming mainly from the thermal power station and to reduce manufacturing costs of the ferrules and other feeding head and supply elements.

The formulations provided by this invention are suitable for the obtention of ferrules and feeding head and supply elements for casting molds, insulation or exothermic. A typical formulation, appropriate for the production of ferrules and exothermic elements is the one identified as Formulation [I].

Formulation [I] (Exothermic)

| Components | % in weight |
|---|---|
| Aluminium silicate hollow microbeads (alumina contents between 20–38% in weight) | 10–90% |
| Aluminium (powder or grain) | 7–40% |
| Agglomerant | 1–10% |

Additionally and optionally, formulation [I] may contain up to 5% in weight of an inorganic fluorine flux such as cryolite, and up to 10% in weight of an oxidant, such as iron oxide or potassic permanganate.

A typical formulation, suitable for the obtention of ferrules and insulating feeding head and supply elements is the one identified as Formulation [II].

Formulation [I] (Insulating)

| Components | % in weight |
|---|---|
| Aluminium silicate hollow micro beads (alumina contents between 20–38% in weight.) | 85–99% |
| Aluminium (grain) | 0–10% |
| Agglomerant | 1–10% |

The formulations provided by this invention may be easily prepared by mixing its components until their total homogeneity is achieved.

The ferrules and feeding head and supply elements provided by this invention may be produced either automatically by blowing of a formulation provided by this invention, or else by means of the self-setting molding technique (manual molding) for forming ferrules and other elements, in those cases in which short production series do not justify investments in tooling.

This invention also provides a procedure for manufacturing ferrules and feeding head and supply elements for casting molds, insulating or exothermic, which uses one of the formulations of this previously described invention, as stock material and comprises the molding of said formulation either manually or else by blowing in a conventional blower machine, polymerizing the resin used by means of adding the appropriate catalyst, and obtaining the ferrule in a short period of time, generally around a few seconds. The dimensional accuracy obtained by means of this procedure is very superior to that obtained by other traditional molding procedures, which permits the consideration of said ferrules and elements as accurate and, consequently, may be easily coupled to the casting mold after being manufactured, without additional handlings and in a manual or automatic manner.

The procedure of the invention, comprises the molding of a formulation in which the refractory material (aluminium silicate) has the shape of hollow micro beads instead of having a fibrillar structure and in which it is possible to add any type of resins. The use of non fibrous solid materials allows the obtention of a homogeneous mixture, of dry appearance, which permits the obtention by means of blowing, in short periods of time, of both internally and externally dimensionally perfect parts.

This procedure permits the production of ferrules and feeding head and supply elements for casting molds, exothermic or insulating, using suitable formulations in each case, by only varying the density of the micro beads, in such a manner that the lower the density of the same, the greater shall be the insulation power of the obtained product. The procedure also permits the use of micro beads with a small specific surface with which the consumption of agglomerant is lower and, therefore, the production cost of the ferrule decreases.

When it is desired to produce ferrules with a large diameter or ferrules for metal molding at low casting temperature (aluminium), the insulation capacity of the ferrule must have priority. On the contrary, when it is desired to produce ferrules with small diameter or for high casting temperature metals, it is of interest to give priority to the exothermic capacity of the ferrule.

One of the advantages of this procedure is that it permits the use of all types of resins and not only the use of specific types of resins. Another important advantage of this procedure refers to that fact that thanks to the great exactness of the shape, both external as internal of the obtained ferrule, the placement of the same inside the flash channel results to be extremely simple. Another additional advantage of this procedure lies in the fact that it permits the obtention of ferrules, insulating or exothermic, in a more rapid and economic manner than those traditionally produced with fibers and by wet means.

The ferrules and feeding head and supply elements provided by this invention, formed by blowing, are comprised of aluminium silicate hollow micro beads with an alumina content below 38% in weight, preferably between 20 and 38%, and of an agglomerant, together with other optional loads in non fibrous form. In general, said ferrules have dimensional exactness, due to which they are easily coupled to the casting mold after production, without additional manipulations and in a manual or automatic manner.

In another aspect of this invention, ferrules and exothermic feeding head and supply elements have been developed which are suitable for nodular casting, ferrules and elements which could be so called "of design", capable of providing minimum quantities of fluorine constituted parting from a formulation provided by the invention, which is suitable for the production of said ferrules or elements though exent from inorganic fluorine fluxes. For this, we part from a mixture based on aluminium silicate hollow micro beads with an alumina content below 38% in weight, preferably comprised between 20 and 38% in weight, and optional loads selected from oxidizable metals and oxidants, such as those previously indicated, mixture which, together with the selected agglomerant resin, is blown inside the molding die where the ferrule or the element in question is to be formed. The blowing operation of this mixture is made use of in order to attach an insert to the bottom of the ferrule or element in question, or on an appropriate zone of the same, the composition of which comprises an inorganic fluorine flux, which has been inserted in the molding die prior to the blowing of the mixture which is exent from inorganic fluorine fluxes. Said innsert acts as primer or initiator of the exothermic reaction. The insert, which has been produced either by the agglomerant or by pressure molding, is constituted by a mixture of oxidizable metals, oxidants and inorganic fluorine fluxes, normally used in the production of the previously indicated ferrules and other feeding and supply elements, together with, optionally, aluminium silicate hollow micro beads or other appropriate elements for thinning or adjusting the exothermicity.

In a particular and preferred embodiment, said insert is made up of an aluminium based mixture of iron oxide and of cryolite and, optionally, of the thinner element of the exothermicity.

The proportion in weight of the insert as regards the ferrule or element in question is comprised between 5 and 20%.

In said design ferrules and exothermic elements, the exothermic reaction is initiated on contact of the cast metal with the insert and extends rapidly and/or in a controlled manner to the rest of the ferrule or element. However, the fluorine detached by said reaction is minimum, since it exclusively comes from the initiator of the exothermic reaction. The fluorine contribution is approximately 5 times less when said insert is used [see Example 2].

Figure 3:
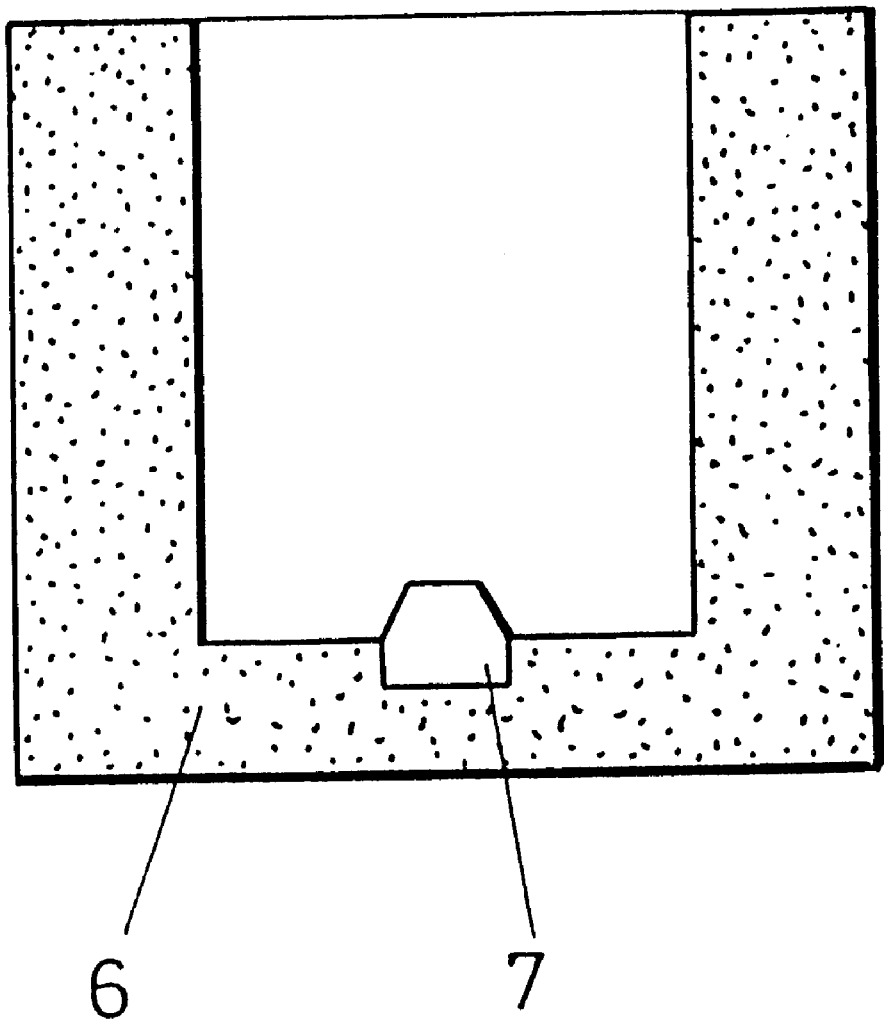
FIG. 3 represents a practical embodiment of an exothermic ferrule suitable for the nodular casting which has an insert attached on its bottom, comprising an inorganic, fluorine flux.

In FIG. 3, an exothermic ferrule is shown (6) appropriate for nodular casting, constituted by a mixture of aluminium silicate hollow micro beads, with an alumina content comprised between 20 and 38% in weight, an oxidizable metal and an oxidant, which contains an insert (7), initiator of the exothermic reaction, based on an oxidizable metal, an oxidant and an inorganic fluorine flux.

Consequently, in a particular embodiment of this invention, a procedure is provided for the production of a ferrule or feeding head and supply element for casting molds, exothermic, appropriate for nodular casting, which comprises the stages of:

insertion in the molding die of an insert comprised of a mixture which is made up of oxidizable metals, oxidants and inorganic fluorine fluxes, and optionally, aluminium silicate hollow micro beads or other thinner or adjusting element of the exothermicity, the weight of which is comprised between 5 and 20% of the total weight of the ferrule or element and which act as initiator of the exothermic reaction; and blowing a mixture of aluminium silicate hollow micro beads, with an alumina content below 38% in weight inside the molding die, preferably comprised between 20 and 38%, oxidizable metals and oxidants, together with an agglomerant. In this blowing operation, the insert which is the initiator of the exothermic reaction remains partially embedded in the ferrule.

Subsequently, the agglomerant resin is cured and the part formed by conventional methods is removed.

EXAMPLE 1

Obtention of the Ferrules

Exothermic ferrules and insulating ferrules are prepared with the following composition.

1. Solids of the Exothermic Mixture

| Component | % in weight |
|---|---|
| -Aluminium silicate hollow Micro beads[a)] (alumina content: 20-:38% in weight) | 55% |
| -Aluminium[b)] (metal powder) | 16% |
| -Aluminium[c)] (metal powder) | 17% |
| -Iron oxide[d)] | 7% |
| -Cryolite[e)] | 5% |

[a)]SG extendospheres (The P.Q. Corporation), absorption in oil (per 100 g): 57,5; density: 0,4 g/ml;
[b)]Pitch <200; purity: 99% Al;
[c)]Granulometry: ≦1 m; purity: 96–99% Al;
[d)]$Fe_3O_4$; granulometry: <150 μm; and
[e)]Granulometry: <63 μm; purity: 99%

2. Solids of the Isolating Mixture

| Component | % in weight |
|---|---|
| - Aluminium silicate hollow micro beads[a)] (alumina content: 20–38% in weight) | 95% |
| - Aluminium[c)] (metal powder) | 5% |

[a)]SG extendospheres (The P.Q. Corporation), absorption in oil (per 100 g) : 57,5; density: 0,4 g/ml; and
[c)]Granulometry: ≦ 1 m; purity: 96–99% Al;

Agglomerant

In both cases, a mixture of Isocure 323 phenolurethan resin (Ashland) and Isocure 623 (Ashland) is used, activatable by a dimethylethylamine (Isocure 702, Ashland) based catalyst in the following proportion:

100 kg of solids of the exothermic mixture;

3 kg of Isocure 323;

3 kg of Isocure 623; and 0,1 kg of Isocure 702.

The mixture of the different components is performed in a blending machine with blades and is shot over a male metallic die with a Roperwork gun with a shooting pressure of 6 kg/cm$^2$. Once the die of males is filled, the catalyst (gas) is made to pass through, hardening the formed mixture, already as a ferrule within 45 seconds. Next, it is demolded, the ferrule thus being ready for use.

The scratch hardness and tensile strength characteristics of the thus obtained ferrules is summarized in the following table:

| | TS | SH |
|---|---|---|
| Output of Die | 85 | 73 |
| 1 hour | 94 | 78 |

-continued

| | TS | SH |
|---|---|---|
| 48 hours | 104 | 73 |
| 1 hr air and 48 hr 100% humidity | 41 | 68 |

where:

SH is the scratch hardness Test Machine: DIETER DETROIT No. 674

TS: is the tensile strength

Tensile Values in kg, for specimens of section 3,5 cm$^2$.

In order to study the operation of the obtained ferrules, a molded steel cube of 97 mm side is cast, following the normal molding and casting practices.

The liquid and solidification shrinkage of the cube is fed by means of a cylindrical ferrule, 50 mm in diameter and .70 mm height, obtained as has been previously indicated. This ferrule is provided with an upper cover of the same material as the ferrule which makes unnecessary the use of an exothermic coverage material.

The cube has a solidification modulus (M) of 1,6 cm, and for its feeding, a feeding head is necessary with a modulus over 1,6 cm.

The geometrical modulus of the ferrule (Mm) used, is of 0,95 cm, that is to say, 1,7 times less. As the drawing does not reach the cube, it can be said that, under the service conditions used, the Modulus Extension Factor (FEM) of the ferrule is:

$$FEM = \frac{M}{mm} = 1,7$$

that is to say, similar to the FEM of a ferrule manufactured with fibers by wet means.

EXAMPLE 2

Obtention of an Exothermic Ferrule with Insert

An insert of 8 g in weight with frustum-conical shape of 20 mm(⊖)×30 mm(h)×10 mm(⊖), is prepared, either by agglomeration or by pressure, with the following composition:

| Components | % in weight |
|---|---|
| Atomized aluminium | 73 |
| Iron oxide | 16 |
| Cryolite | 11 |

The insert is placed in the selected housing over a die of males which serves to produce the exotheric ferrule (base ferrule) by blowing a mixture of solids made up of:

| Components | % in weight |
|---|---|
| Aluminium silicate hollow micro beads (alumina contents below 38%) | 60 |

-continued

| Components | % in weight |
|---|---|
| Atomized aluminium | 33 |
| Iron oxide | 7 |

which is agglomerated with a mixture of 3% weight of Isocure 323 (Ashland) and 3% weight of Isocure 623 (Ashland). After the blowing on the die of males, it is gassed with Isocure 702 (Ashland) the mixture becoming hardened by the action of the gas.

As a final result, a ferrule of 113 a total weight is obtained, with an insert of 8 g in weight which shall act as primer and shall prevent or minimize the need of using cryolite (55% weight fluorine content) in the base ferrule with the purpose of contributing the minimum possible quantity of fluorine to the sand circuit in which the part shall be cast with said ferrule.

1. Weight of the base ferrule: 105 g Contribution of fluorine in the cryolite: 0 g
2. Weight of insert: 8 g Weight of fluorine: 8×0,11×0,55:0,48 g
3. Total fluorine in the ferrule: 0,48 g However, in the exothermic ferrule obtained according to the procedure disclosed in Example 1, the fluorine content is of 2,585 g, that is to say, approximately 5,4 times greater, with which the contribution of fluorine to the green sand circuit shall be substancially greater.

What is claimed is:

1. A formulation for production by blow molding and cold die curing of insulating or exothermic ferrules and other feeding head and supply elements for casting molds, comprising:

(i) aluminium silicate hollow micro beads, with an alumina content below 38% in weight; and (ii) a cold die cure agglomerant.

2. The formulation according to claim 1, wherein said cold die cure agglomerant is a resin selected from the group consisting of phenol-urethane resins, activated by amines, epoxy-acrylic resins, activated by $SO_2$, alkaline phenolic resins, activated by $CO_2$ or by methyl formate, and sodium silicate resins, activated by $CO_2$.

3. The formulation according to claim 1, in which said aluminium silicate hollow micro beads have an alumina content comprised between 20 and 38% in weight.

4. The formulation according to claim 1, wherein said aluminium silicate hollow micro beads have a grain diameter of up to 3 mm.

5. The formulation according to claim 1, which comprises:

Components % in Weight

Aluminium Silicate Hollow Micro Beads (Alumina content between 20–38% wt.) 10–90%

Aluminium (Powder or Grain) 7–40%

Agglomerant 1–10%.

6. The formulation according to claim 5, which also comprises, up to 5% in weight of an inorganic fluorine flux and up to 10% weight of an oxidant.

7. The formulation according to claim 1, which comprises:

Components % in Weight

Aluminium Silicate Hollow Micro Beads (Alumina content between 20–38% wt.) 85–99%

Aluminium (Grain) 0–10%

Agglomerant 1 –10%.

8. A procedure for the production of insulating or exothermic ferrules and other feeding head and supply elements for casting molds, by blow molding and cold die curing, comprising:

(A) introducing, by blowing, into a molding box a formulation appropriate for the production of insulating or exothermic ferrules and other feeding head and supply elements for casting molds according to claim 1, in order to form an uncured molded product;

(B) contacting the uncured molded product with a catalyst to cure said product; and (C) removing the molded product from the molding box.

9. A ferrule prepared according to claim 8.

* * * * *